United States Patent [19]

Basler et al.

[11] Patent Number: 4,947,559

[45] Date of Patent: Aug. 14, 1990

[54] AIR PRESS SYSTEM

[75] Inventors: Peter Basler, Verona; Robert Lancaster, Berlin, both of N.J.; Gunther Weiskopf, New York, N.Y.

[73] Assignee: Bobst, SA, Lausanne

[21] Appl. No.: 334,601

[22] Filed: Apr. 6, 1989

[51] Int. Cl.[5] ..... F26B 19/00

[52] U.S. Cl. ..... 34/70; 34/145; 34/242; 34/116

[58] Field of Search ..... 277/12, 53; 34/242, 34/207, 114, 156, 123, 145, 144, 70, 116

[56] References Cited

U.S. PATENT DOCUMENTS 4,192,516 3/1980 McCort ..... 34/242

*Primary Examiner*—Henry A. Bennet

*Attorney, Agent, or Firm*—Hill, Van Santen, Steadman & Simpson

[57] ABSTRACT

An air press for use in drying web material, such as corrugated board, characterized by a plurality of individual plenums pressing a double-backer belt against the web material as it is being transported over a plurality of steam chests for drying. Each of the plenums is provided with brushes for sealing the periphery of the plenum relative to the belt and has an individual blower and an individual venting door so that both the humidity of the air in the plenum, as well as the pressure, can be individually controlled.

9 Claims, 1 Drawing Sheet

AIR PRESS SYSTEM

BACKGROUND OF THE INVENTION

The present invention is directed to an improved air press system which utilizes a plurality of air plenums above a belt for holding the belt on a corrugated board as it passes over heating elements to dry the board.

In drying double-back corrugated boards during a gluing process, it was known to use a plurality of ballast rolls to apply pressure on the board as it was being passed over the heating elements, such as steam chests. A problem with this procedure is that the rolls would sometimes crush the corrugated board so that it would have a reduced height of between 0.01" and 0.02" and the crushing would also result in a loss of strength for the board.

To overcome the problems of crushing, it has been suggested to utilize a plurality of air plenums which were positioned over a double-backer belt to apply pressure on the board as it moved over the steam chests. These plenums were carefully adjusted to provide a small gap between the peripheral edge and a double-back belt and, thus, when changing the thickness of the double-backed corrugated board, the plenums would need to be raised and lowered by a corresponding amount.

Other problems occur in such a device, in addition to the time required for setting it up for a change in thickness for the corrugated board being processed. For example, the device did not apply sufficient pressure to certain portions of the corrugated sheet, while it applied excessive pressure to other portions. In addition, since each of the plenums was provided with the edges extremely close to the board, which is in a form of a web, to minimize air loss, the change of air in each plenum was substantially less and this air had a tendancy to have excessive moisture after the drying operation had started.

SUMMARY OF THE INVENTION

The object of the present invention is to overcome the shortcomings of the previously used ballast rolls for applying pressure on the corrugated board as it is being passed through a drying device and to overcome the drawbacks and disadvantages of previously used plenum systems.

These objects are achieved in an improvement in an air press having a continuous double-backer belt moving over a plurality of heating elements for dragging a double-back corrugated board through the system for drying, said device having a plurality of plenums disposed above the belt for applying a pressure on the belt to hold the corrugated board in a flat condition. The improvements are that each of the plenums is subdivided into separate chambers with each chamber having a separately controllable blower motor, and the periphery of each of the plenums is provided with a brush to form a seal. In addition, each of the plenums is provided with an adjustable means to vent the plenum so that the volume of air transferred through the plenum can be controlled to reduce moisture buildup therein. Each of the plenums is rigidly mounted in the air press and the bristles of the brushes on the periphery of each of the plenums enables accepting boards of different thicknesses within a given range, such as a thickness range of 1/16" to ½" without requiring any adjustment or positioning of the plenums.

Each of the plenums has a separate blower for creating the air pressure therein, and, each plenum has adjustable means which can be opened and closed to insure enough exchange of the air in the plenum to prevent a moisture buildup and to create a desired pressure.

Other advantages and features of the present invention will be readily apparent from the following description of the preferred embodiment, the drawings and the claims.

DESCRIPTION OF THE PREFERRED EMBODIMENTS

Figure 1:
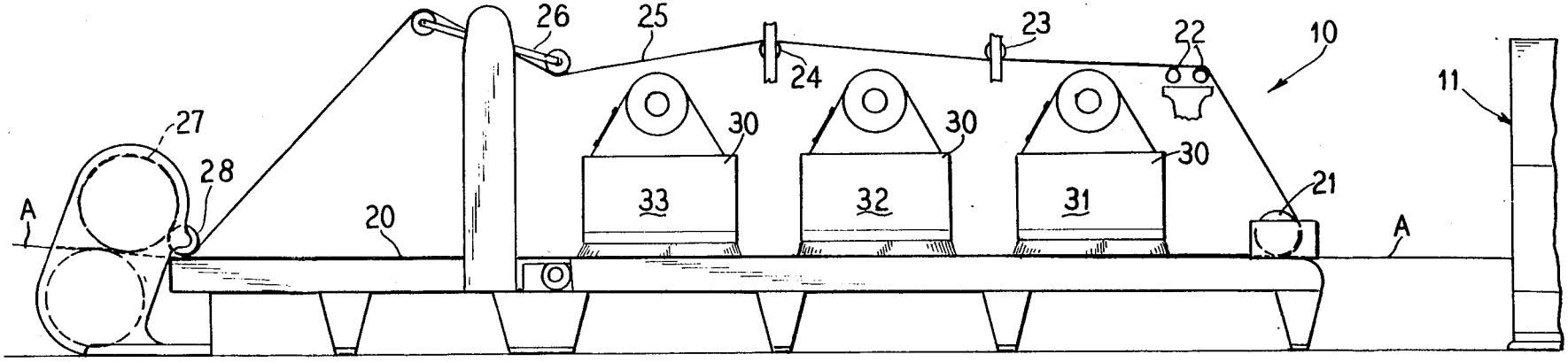
FIG. 1 is a side view schematically illustrating an air press in accordance with the present invention.
Figure 2:
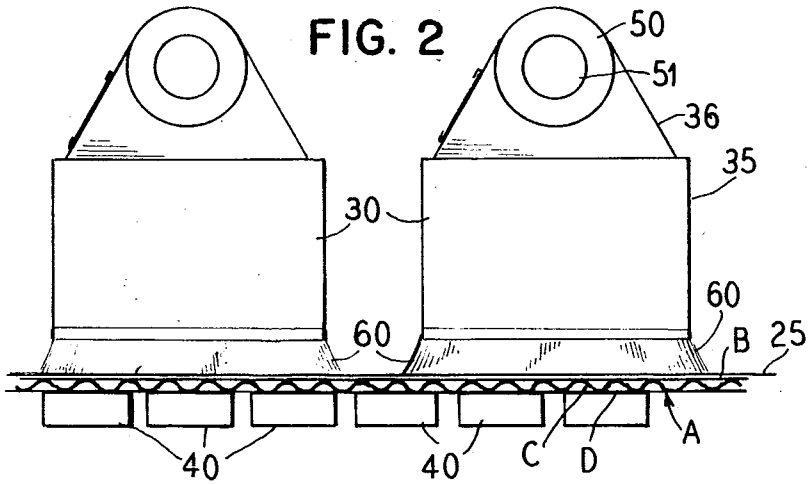
FIG. 2 is an enlarged side view of two of the plenums.

The principles of the present invention are particularly useful in an air press, generally indicated at 10 in FIG. 1. The air press 10 is illustrated as being in line with other equipment for receiving an uncombined corrugated board which has a corrugated web C with the flutes (FIG. 2) coated with wet glue being disposed between outer webs B and D. The press is used for drying the uncombined corrugated board into a finished corrugated board A so that it can have the desired strength when it leaves the press. As illustrated in FIG. 1, the press 10 is located adjacent a discharge end of a machine 11, which applies glue to the fluted center web C, which is arranged between the two outer webs B and D and discharges the arrangement of webs B, C, D with the glue still wet to the press 10 for drying. The board A, which is in the form of a web, leaves the press 10 and is subsequently treated by being slit and cut into the desired size. The gluing machine and slitting and cutting machines are conventional.

Figure 3:
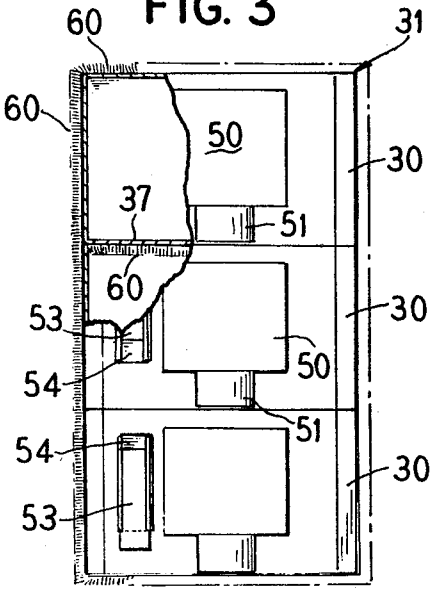
FIG. 3 is a top plan view of a row of plenums with portions broken away for purposes of illustration.

As illustrated in FIG. 1, the press 10 has a frame 20 which supports a plurality of rollers 21, 22, 23, 24 for a belt 25, which is a double-backer belt. In addition, the frame 20 supports a slack take-up arrangement 26 and, adjacent the left-hand end, has a drive arrangement including the drive roll 27 coacting with a roller 28 for driving the double-backer belt 25. Disposed above the belt are a plurality of plenums 30, which, as illustrated in FIG. 1, are arranged in three rows 31, 32 and 33. As best illustrated in FIG. 3, each of the rows, such as the row 31, has three plenums arranged side-by-side.

The frame 20 also supports a plurality of heating means or elements, such as steam chest 40 (see FIG. 2), which are positioned below the plenums 30 and over which the corrugated board A passes to be dried while moving through the press 10.

Each of the plenums 30, as illustrated, has a chamber 35 with a rectangular configuration with side walls which have a converging top portion 36 provided with a separate blower 50, which is operated by a motor 51. Each of the top portions is provided with a sliding door 53 which can be moved relative to an opening or aperture 54 from a closed position to various open positions to enable controlling the amount of air or gas escaping from the interior of the plenum through the aperture 54 (see FIG. 3). To seal the lower periphery of the plenum, each of the side walls terminates in brushes 60 which engage the belt 25 and form a seal therewith. By providing the brushes 60 on all walls, including a partition or common wall 37 extending between two adjacent plenums, as illustrated in FIG. 3, the pressure in each plenum is sealed from both the ambient outside pressure as well as the pressure in adjacent plenums.

Figure 4:
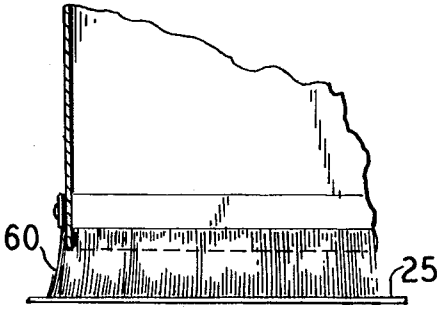
FIG. 4 is an enlarge partial cross sectional view showing the long periphery of the plenum.

The brushes have bristles which are approximately 1½ inches long and the brushes are mounted on the edge of the walls forming the plenum in an appropriate manner, as illustrated in FIG. 4. By providing brushes with a length of 1½ inches, the bristles are sufficiently flexible that they will form a seal while processing a corrugated board having various thicknesses in a range of 1/16 inch to ½ inch. Thus, when the thickness of the corrugated board being processed changes, the brushes automatically compensate for the change in the thickness. In other words, each of the plenums is rigidly mounted in a fixed position on the frame 20 and do not require adjustments, such as in the previous air presses.

As mentioned above, the provision of each of the doors 53 enables adjusting the amount of air in each plenum that escapes. Thus, the operator of the press can maintain the desired amount of air flow to maintain the desired humidity. If the air flow is too small, moisture from the wet glue will accumulate in the plenum raising the humidity and, thus, hamper the drying of the glue.

Preferably, the motors are constant speed motors and the operator can maintain the desired humidity in the air in each chamber and also vary the pressure being exerted on the belt 25 to hold the corrugated board in the desired position as it moves through the air press by varying the size of the openings or apertures 54 of each of the plenums. If each of the motors 51 for each of the blowers 50 is a separately controlled motor, the operator could then change the speed of the motor to also change the output of the blower in addition to changing the position of the door 53 to regulate the amount of air flow through the plenum. Thus, while the addition of variable speed motors would provide additional flexibility in controlling the pressure and air flow in each of the plenums, it is believed that the use of constant speed motors for each of the plenums, which would be less expensive, still provides adequate control over the pressure and air flow in each plenum by controlling the size of the opening to control the amount of venting. Thus, the presence of individually controlled vents for each plenum enables the operator to process any combination of corrugated paper while achieving good, acceptable quality board.

Although various minor modifications may be suggested by those versed in the art, it should be understood that we wish to embody within the scope of the patent granted hereon all such modifications as reasonably and properly come within the scope of our contribution to the art.

We claim:

1. An air press for drying corrugated cardboard, said press comprising a frame, a plurality of heating means arranged along the length of the frame for drying web material being transported thereover, a continuous belt for moving the web material over the plurality of heating means, a plurality of individual plenums, each of said plenums having a chamber under pressure and with a peripheral edge, said plenums being mounted on the frame with the peripheral edges facing the belt and each plenum having means including brushes on the peripheral edge of the chambers engaging the belt for maintaining the pressure in the chamber on said belt to urge the belt into contact with the web material.

2. An air press for drying corrugated cardboard, said press comprising a frame, a plurality of heating means arranged along the length of the frame for drying web material being transported thereover, a continuous belt for moving the web material over the plurality of heating means, a plurality of individual plenums mounted on the frame for urging the belt into contact with the web material, each of said plenums having a chamber under a pressure with a peripheral edge facing the belt, each edge having a peripheral seal formed by brushes, and each of the plenums having vent means for adjustably venting the interior of the plenum so that the pressure developed in each plenum can be individually adjusted.

3. An air press according to claim 2, wherein each of the plenums has a separate blower powered by a separate motor.

4. An air press according to claim 2, wherein the vent means comprises a door slidable relative to an aperture in the chamber of the plenum for varying the size of said aperture.

5. An air press according to claim 1, wherein the brushes have bristles which are approximately 1½ inches long, said brushes providing a seal for the plenum which will automatically compensate for changes of thickness of the web material being processed in a range of thickness of 1/16 inch to ½ inch.

6. An air press according to claim 1, wherein the plenums are arranged in rows extending across the frame, said periphery of each plenum having brushes to isolate the pressure in the plenum from the ambient pressure and from that of the adjacent plenum.

7. An air press for drying web material, said air press comprising a frame, heating means being disposed on said frame for heating a web material being moved thereover, drive means for moving the web material in a path over said heating means including a continuous belt engaging an upper surface of the web material being processed, a plurality of plenums being fixed on the frame urging said belt against the web material being transported through the press, each of said plenums having flexible means on a periphery of a chamber of the plenum for engaging said belt to create a seal therewith, said flexible means comprising brushes, each of the plenums having a separate blower driven by a separate drive motor, and each of the plenums being provided with adjustable means for venting of the plenum chamber so that the adjustable means can be individually adjusted for each plenum to obtain the desired pressure therein and the desired flow of air therethrough.

8. An air press according to claim 7, wherein each of the adjustable means comprises a door slidable relative to an opening to vary the amount of opening uncovered by the door.

9. An air press according to claim 7, wherein the heating means comprises steam chest.

* * * * *